United States Patent [19]

Horneck et al.

[11] Patent Number: 4,950,837

[45] Date of Patent: Aug. 21, 1990

[54] METHOD FOR RECLASSIFYING PCB TRANSFORMERS

[75] Inventors: Craig W. Horneck, Scotia; John B. McDermott, Rexford; Daniel P. Smith, Ballston Spa; Shiro G. Kimura, Schenectady; Roger A. Shisler, Ballston Spa, all of N.Y.

[73] Assignee: General Electric Company, Schenectady, N.Y.

[21] Appl. No.: 381,236

[22] Filed: Jul. 18, 1989

[51] Int. Cl.[5] ..... B01D 15/00

[52] U.S. Cl. ..... 174/14 R; 210/690; 210/909; 336/58

[58] Field of Search ..... 210/634, 694, 909, 690; 336/58; 134/22.14, 22.19; 174/14 R

[56] References Cited

U.S. PATENT DOCUMENTS

| | | | |
|---|---|---|---|
| 4,124,834 | 11/1978 | Walsh | 336/58 |
| 4,127,598 | 11/1978 | McEntee | 260/448.2 E |
| 4,299,704 | 11/1981 | Foss | 210/634 |
| 4,353,798 | 10/1982 | Foss | 210/181 |
| 4,425,949 | 1/1984 | Rowe, Jr. | 141/1 |
| 4,526,677 | 7/1985 | Grantham et al. | 208/262 |
| 4,578,194 | 3/1986 | Reinartz et al. | 210/909 |
| 4,685,972 | 8/1987 | Fowler | 134/12 |
| 4,738,780 | 4/1988 | Atwood | 210/909 |
| 4,744,905 | 5/1988 | Atwood | 210/634 |

OTHER PUBLICATIONS

J. Reason and W. Bloomquist, "PCB Replacements: Where the Transformer Industry Stands Now", *Power*, Oct., 1979, pp. 64–65.

T. O'Neil and J. J. Kelly, "Silicone Retrofill of Askarel Transformers", *Proc. Elec./Electron, Insul, Conf.*, 13, 167–170 (1977).

Federal Register, vol. 48, No. 1, Jan. 3, 1983, pp. 121 and 125–136 Polychlorinated Biphenyls (PCBs) Manufacturing, Processing, Distribution in Commerce and Use Prohibitions; Amendment: To Use Authorization for PCB Railroad Transformers.

R. H. Parrish and S. D. Myers, "An Update of the Use, Labeling, Handling and Disposal of PCBs", IEEE Cat., #0190–2172/81, pp. 15–24.

Gilbert Addis and Bentsu Ro, "Equilibrium Study of PCB's Between Transformer Oil and Transformer Solid Materials", EPRI PCB Seminar, Dec. 3, 1981.

*Primary Examiner*—Ivars Cintins

*Attorney, Agent, or Firm*—Robert A. Cahill

[57] ABSTRACT

The present invention is directed to a method for reducing PCB concentration in an electrical induction apparatus containing a dielectric fluid with greater than 500 ppm PCB to a level of less than about 50 ppm PCB. Dielectric fluid containing greater than 500 ppm PCB is drained from an electrical induction apparatus, and the drained apparatus then is filled with tetrachloroethylene as a first interim dielectric fluid. The apparatus is then electrically operated with the first interim dielectric fluid so as to attain about an equilibrium PCB concentration in the first fluid. The first interim dielectric fluid then is drained from the apparatus and replaced with fresh tetrachloroethylene as a second interim dielectric fluid. The apparatus then is electrically operated with the second interim dielectric fluid so as to attain about an equilibrium PCB concentration in the second fluid. The second interim dielectric fluid then is drained from the apparatus and replaced with a silicone fluid as a permanent dielectric fluid. The apparatus filled with permanent dielectric fluid is electrically operated and the permanent dielectric fluid is filtered through a carbon filter, so as to attain a PCB concentration in the permanent fluid of less than about 50 ppm.

26 Claims, 1 Drawing Sheet

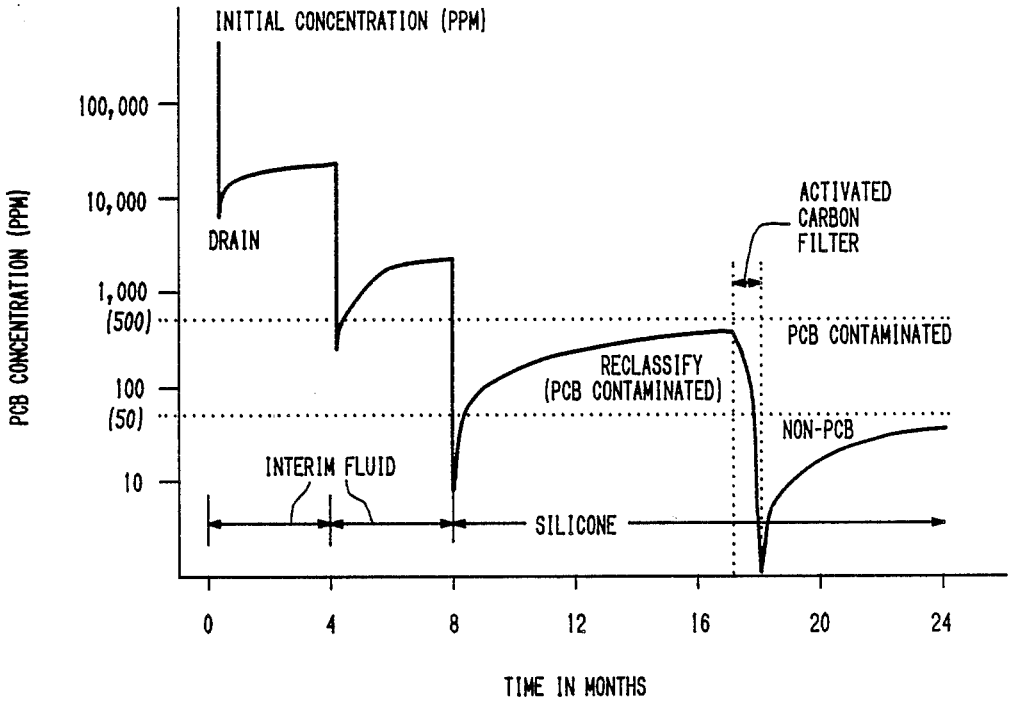
INITIAL CONCENTRATION (PPM)
100,000
10,000
1,000
(500)
100
(50)
10
PCB CONCENTRATION (PPM)
DRAIN
ACTIVATED
CARBON
FILTER
PCB CONTAMINATED
RECLASSIFY
(PCB CONTAMINATED)
NON-PCB
INTERIM FLUID
SILICONE
0
4
8
12
16
20
24
TIME IN MONTHS

METHOD FOR RECLASSIFYING PCB TRANSFORMERS

Field of Invention

This invention relates to electrical induction apparatus, such as electric power transformers. More specifically, this invention relates to dielectric fluids used as coolants in such transformers, especially polychlorinated biphenyl, PCB, and a process for the removal of PCB's from transformers.

Background of the invention

Transformers containing a dielectric fluid with greater than 500 ppm of polychlorinated biphenyl (PCB) are subject to strict regulations and are a source of potential liability for the owner. By 1990, many of these transformers will have to be modified, removed or reclassified as a result of the 1985 "Fire Hazard Rule." Reclassification of the transformer requires the transformer dielectric fluid to maintain a PCB concentration below the classification concentration for 90 days of operation with no external equipment or apparatus attached.

Currently there are two types of processes available in the marketplace for this service. The first involves periodic replacements of the dielectric fluid with a PCB-free dielectric fluid. The transformer is operated for several months with this replacement fluid in order to leach out any PCB that was left in the internal components of the transformer after the initial draining of the dielectric. This drain, refill and leach procedure is repeated several times until the unit can meet the reclassification requirements. An example of a process of this type is the Unison Reclass 50 (process which uses a proprietary dielectric, TF-1. U.S. Pat. Nos. 4,738,780 and 4,744,905, issued to Atwood, describe this process. This process results in many drainings and refills which increases the cost of removing the PCBs. This increased handling of PCB material increases the risk that drained fluid will be spilled or otherwise contaminate the environment.

The second type of process continuously removes the PCB material that leaches from the internal components of the transformer by attaching a processor that separates the PCB from the replacement dielectric. When a sufficient amount of PCB has been removed, the processor is detached from the transformer and the reclassification period begins. An example of this type of process is the Westinghouse TransForm TM which uses a proprietary replacement dielectric, TDR-3. The practice of this process as described in U.S. Pat. No. 4,685,972, issued to Fowler, requires considerable equipment which is expensive in both implementation and operation.

Another technology for removing "toxic organic contaminants" from the dielectric fluid of an electrical induction apparatus such as a transformer is described in U.S. Pat. No. 4,124,834, issued to Walsh. This technology is an electrical induction apparatus onto which is installed an adsorbent filter through which the dielectric fluid circulates. As the fluid passes through the filter, the organic contaminant is removed. As noted in column 4, lines 17–26 of U.S. Pat. No. 4,744,905 to Atwood, ". . . the filtration scheme could be a reasonably effective, though expensive, procedure if it were not for the fact that the leach rate is so slow that it could take many years to reduce the residual PCB to a point where the final leach is reduced to an acceptable value." (citing Gilbert Addis and Bentsu Ro, "Equilibrium Study of PCB's Between Transformer Oil and Transformer Solid Materials", EPRI PCB Seminar, Dec. 3, 1981). This technology is not believed to be currently available in the marketplace.

There remains a need in the art for a relatively rapid process for removing PCB from transformers while avoiding the numerous refills or high power costs of prior art systems.

Summary of the Invention

The present invention is directed to a method for reducing PCB concentration in an electrical induction apparatus containing a dielectric fluid with greater than 500 ppm PCB to a level of less than about 50 ppm PCB, comprising draining dielectric fluid containing greater than 500 ppm PCB from an electrical induction apparatus; filling the drained apparatus with a first interim dielectric fluid comprised of tetrachloroethylene; electrically operating said apparatus filled with said first interim dielectric fluid so as to attain about an equilibrium PCB concentration in the first fluid; draining the first interim dielectric fluid from said apparatus and replacing said first fluid with a second interim dielectric fluid comprised of tetrachloroethylene; electrically operating said apparatus filled with said second interim dielectric fluid so as to attain about an equilibrium PCB concentration in the second fluid; draining the second interim dielectric fluid from said apparatus and replacing said second fluid with a permanent dielectric fluid comprised of silicone fluid; electrically operating said apparatus filled with said permanent dielectric fluid; and filtering said permanent dielectric fluid through a carbon filter while electrically operating said apparatus filled with said permanent dielectric fluid so as to attain a PCB concentration in the permanent fluid of less than about 50 ppm.

Brief Description of the Drawing

The sole FIGURE is a graph depicting the reduction of PCB concentration effected by the process of the invention.

Detailed Description of the Invention

Applicants surprisingly have found that the process of this invention results in the reclassification of a PCB-containing electrical induction apparatus or transformer to non-PCB status after several flush refills and the brief use of a carbon filter. Application of the process requires few interruptions of transformer operation and renders long-term maintenance of low PCB concentrations in the dielectric fluid possible.

The method of the present invention involves reducing PCB concentration in an electrical induction apparatus containing a dielectric fluid with greater than 500 ppm PCB to a level of less than about 50 ppm PCB by first draining dielectric fluid containing greater than 500 ppm PCB from an electrical induction apparatus. The drained apparatus may be flushed with tetrachloroethylene to remove any PCB from internal surfaces and bottom surfaces of the electrical induction apparatus. After the apparatus is drained, it is filled with a first interim dielectric fluid, which, in the presently described embodiment, is comprised of tetrachloroethylene ("TCE"). The electrical induction apparatus then is electrically operated while filled with the first interim dielectric fluid so as to attain a PCB level in the first interim dielectric fluid of greater than about 10,000 ppm. In preferred embodiments, the apparatus is electrically operated to attain a PCB level in the first interim fluid of greater than about 15,000 ppm. In more preferred embodiments, the apparatus is electrically operated until the first interim fluid has a PCB level of greater than about 20,000 ppm. In order to achieve the desired level of PCB in the first interim fluid, it is generally necessary to operate the apparatus for at least about four months, and it may be necessary to operate the apparatus for at least six months. In particularly preferred embodiments, the apparatus is operated so as to attain about an equilibrium PCB concentration in the first interim fluid. This generally is at a PCB level of about 25,000 ppm in the first interim fluid, and occurs within about four to 12 months of operation. The PCB concentration may be monitored to determine when equilibrium has been reached.

After the desired concentration of PCB is reached in the first interim fluid, and/or equilibrium is reached, the first interim dielectric fluid is drained from the apparatus and replaced with a second interim dielectric fluid, which, in the presently described embodiment, is comprised of TCE. The apparatus may be flushed before the fluid is replaced.

The apparatus is electrically operated with the second interim fluid so as to attain a PCB level in the second interim fluid of greater than about 500 ppm. In preferred embodiments, the apparatus is electrically operated to attain a PCB level in the second interim fluid of greater than about 1,000 ppm. In more preferred embodiments, the apparatus is electrically operated until the second interim fluid has a PCB level of greater than 1,100 or 1,200 ppm. In order to achieve the desired level of PCB in the second interim fluid, it generally is necessary to operate the apparatus for at least about four months, and it may be necessary to operate the apparatus for at least six months. In particularly preferred embodiments, the apparatus is operated so as to attain an equilibrium PCB concentration in the second interim fluid. This generally is at a PCB level of between about 1,200–1,300 ppm, e.g., about 1,250 ppm, which generally occurs within about four to twelve months of operation. The apparatus then is drained of the second interim dielectric fluid. If desired, the process step using the second interim fluid may be repeated.

The second interim fluid is replaced with a permanent dielectric fluid, which, in the presently described embodiment, is comprised of silicone fluid. The apparatus is electrically operated with the permanent dielectric fluid and the permanent dielectric fluid is filtered through a carbon filter to attain a PCB concentration in the permanent fluid of less than about 50 ppm. The apparatus may be operated for 6–12 months before the filter is attached.

As indicated, the process of this invention comprises two stages, each utilizing a different dielectric fluid. The stages of the invention are illustrated in the FIGURE. The first stage begins with electrical isolation of the transformer and drainage of the dielectric fluid. In the FIGURE, the graph illustrates the drainage of the dielectric fluid from the electric induction apparatus. At this point, at zero time, the initial concentration goes from well above 100,000 ppm to below 10,000 ppm from the act of draining the electrical induction apparatus of the PCB-containing fluid. This dielectric fluid is most likely a blend of PCB and TCB known in the industry as askarel or Pyranol. TM This PCB dielectric fluid is then removed from the site and subjected to an EPA approved destruction method.

During this service outage, the gaskets on the transformer are replaced with gaskets of a material compatible with the two replacement dielectric fluids, TCE and silicone fluid. At the same time, fittings are attached to the transformer to allow quick connection of the activated carbon filter to be installed during the second stage of the process.

The unit then may be flushed with TCE to remove any PCB from the internal surfaces and the bottom of the transformer. The flush fluid is drained and either sent to destruction or sent to some off-site solvent recovery. The flushed transformer is filled with TCE and returned to service. The transformer is electrically operated with TCE as the dielectric fluid for a period of four months to one year. This period is shown in the FIGURE. As the apparatus operates between 0 and 4 months, the amount of PCB in the dielectric fluid increases. During this period the PCB concentration can be monitored to ascertain when equilibrium is reached. After equilibrium is established, the transformer is removed from service and drained. In the embodiment shown in the FIGURE, equilibrium was reached after about four months. Equilibrium is reached when the amount of PCB passing into the dielectric fluid from the transformer parts is equal to the amount of PCB returned to the transformer parts from the dielectric fluid. Thus, to remove further PCBs, the fluid can be replaced.

At the equilibrium point, the transformer is flushed, refilled with PCB-free TCE and returned to service for an additional four to 12 months. Again, the fluid is periodically sampled in order to monitor the approach to equilibrium. As shown in the FIGURE, the equilibrium point is reached after another four months and the PCB concentration is at about 1,200 ppm. Additional TCE refills are possible if deemed necessary or desirable.

The second stage of the process begins at the end of the TCE refills and requires the transformer to be removed from electrical operation. During this outage, the TCE is drained from the transformer and replaced with a silicone dielectric fluid. As shown in the FIGURE, once the TCE is drained from the electrical induction apparatus, the PCB concentration drops to almost 1 ppm. The first reclassification period can begin with the return of the transformer to electrical operation. As illustrated in the FIGURE, after 90 days the transformer dielectric fluid will be less than 500 ppm PCB and the transformer reclassified to PCB contaminated status.

To obtain reclassification to non-PCB status, an activated carbon filter unit is attached to the transformer via the connectors that were installed during the first stage. This filter unit comprises a modular bed of activated carbon adsorbent, a pump, a transformer temperature monitor, a fluid level monitor and emergency shutoff valves that would isolate the unit from the transformer if at any time the monitors detected a deviation from normal operating conditions. This filter unit would be attached to the transformer for a period sufficiently long to reduce the PCB concentration in the dielectric fluid to well below the reclassification requirements, preferably below 10 ppm. This period generally would last no longer than about 1–2 months. If during this time the activated carbon should become saturated with PCB, the modular bed could be removed and replaced with PCB-free one without disturbing the transformer operation. Once the PCB concentration is reduced to well less than the reclassification requirement, the filter is removed and the second reclassification period begins, resulting in non-PCB status for the reformer. The filter stage is shown in the FIGURE as beginning at about 17 months and ending at about 18 months. The use of the filter causes the PCB concentration to decrease significantly.

If at any time during the reclassification, or many years afterward, the concentration in the dielectric fluid increases to a level higher than that considered satisfactory by the owner, the carbon unit can be reinstalled onto the transformer, without a service interruption, through the connectors put in place during the first stage of the process. This capability to go back to the transformer many years later and reduce the PCB concentration is a distinct advantage of the process described herein Since many modifications, variations and changes n detail may be made to the described embodiment, it is intended that all matter in the foregoing description and shown in the accompanying drawing be interpreted as illustrative and not in a limiting sense.

I claim:

1. A method for reducing PCB concentration in an electrical induction apparatus containing a dielectric fluid with greater than 500 ppm PCB to a level of less than about 50 ppm PCB, comprising:

(a) draining dielectric fluid containing greater than 500 ppm PCB from an electrical induction apparatus;

(b) filling the drained apparatus with a first interim dielectric fluid comprised of tetrachloroethylene;

(c) electrically operating said apparatus filled with said first interim dielectric fluid so as to attain about an equilibrium PCB concentration in the first fluid;

(d) draining the first interim dielectric fluid from said apparatus after attaining the equilibrium PCB concentration of (c) and replacing said first fluid with a second interim dielectric fluid comprised of tetrachloroethylene;

(e) electrically operating said apparatus filled with said second interim dielectric fluid so as to attain about an equilibrium PCB concentration in the second fluid;

(f) draining the second interim dielectric fluid from said apparatus after attaining the equilibrium PCB concentration of (e) and replacing said second fluid with a permanent dielectric fluid comprised of silicone fluid;

(g) electrically operating said apparatus filled with said permanent dielectric fluid; and (h) filtering said permanent dielectric fluid through a carbon filter while electrically operating said apparatus filled with said permanent dielectric fluid so as to attain PCB concentration in the permanent fluid of less than about 50 ppm.

2. The method of claim 1 wherein the electrical induction apparatus is electrically isolated before draining the dielectric fluid.

3. The method of claim 1 wherein the electrical induction apparatus is flushed with tetrachloroethylene after steps (a) and (d) to remove any PCB from internal and bottom surfaces of the electrical induction apparatus.

4. The method of claim 1 wherein the electrical induction apparatus is monitored to ascertain when equilibrium is reached.

5. The method of claim 1 wherein between steps (a) and (b), gaskets on the electrical induction device are replaced with gaskets of a material compatible with tetrachloroethylene and silicone fluid.

6. A method for reducing PCB concentration in an electrical induction apparatus containing a dielectric fluid with greater than 500 ppm PCB to a level of less than about 50 ppm PCB, comprising:

(a) draining dielectric fluid containing greater than 500 ppm PCB from an electrical induction apparatus;

(b) filling the drained apparatus with a first interim dielectric fluid comprised of tetrachloroethylene;

(c) electrically operating said apparatus filled with said first interim dielectric fluid so as to attain about an equilibrium PCB concentration in the first fluid of greater than about 10,000 ppm;

(d) draining the first interim dielectric fluid from said apparatus after attaining the PCB concentration of (c) and replacing said first fluid with a second interim dielectric fluid comprised of tetrachloroethylene;

(e) electrically operating said apparatus filled with said second interim dielectric fluid so as to attain about an equilibrium PCB concentration in the second fluid of greater than about 500 ppm;

(f) draining the second interim dielectric fluid from said apparatus after attaining the PCB concentration of (e) and replacing said second fluid with a permanent dielectric fluid comprised of silicone fluid;

(g) electrically operating said apparatus filled with said permanent dielectric fluid; and (h) filtering said permanent dielectric fluid through a carbon filter while electrically operating said apparatus filled with said permanent dielectric fluid so as to attain a PCB concentration in the permanent fluid of less than about 50 ppm.

7. The method of claim 6 wherein, prior to draining, the PCB concentration in the first interim dielectric fluid is greater than about 15,000 ppm.

8. The method of claim 6 wherein, prior to draining, the PCB concentration in the first interim dielectric fluid is greater than about 20,000 ppm.

9. The method of claim 6 wherein, prior to draining, the PCB concentration in the first interim dielectric fluid is about 25,000 ppm.

10. The method of claim 6 wherein, prior to draining, the PCB concentration in the second interim dielectric fluid is greater than about 1000 ppm.

11. The method of claim 6 wherein, prior to draining, the PCB concentration in the second interim dielectric fluid is greater than about 1100 ppm.

12. The method of claim 6 wherein, prior to draining, the PCB concentration in the second interim dielectric fluid is greater than about 1200 ppm.

13. The method of claim 6 wherein prior to draining, the PCB concentration in the second interim dielectric fluid is between about 1200 and 1300 ppm.

14. The method of claim 6 wherein the electrical induction apparatus is electrically isolated before draining of dielectric fluid.

15. The method of claim 6 wherein the electrical induction apparatus is flushed with tetrachloroethylene after steps (a) and (d) to remove any PCB from internal and bottom surfaces of the electrical induction apparatus.

16. The method of claim 6 wherein the electrical induction apparatus is monitored to ascertain when equilibrium is reached.

17. The method of claim 6 wherein between steps (a) and (b), gaskets on the electrical induction device are replaced with gaskets of a material compatible with tetrachloroethylene and silicone fluid.

18. A method for reducing PCB concentration in an electrical induction apparatus containing a dielectric fluid with greater than 500 ppm PCB to a level of less than about 50 ppm PCB, comprising:

(a) draining dielectric fluid containing greater than 500 ppm PCB from an electrical induction apparatus;

(b) filling the drained apparatus with a first interim dielectric fluid comprised of tetrachloroethylene;

(c) electrically operating said apparatus filled with said first interim dielectric fluid for at least about four months to attain about an equilibrium PCB concentration in the first fluid;

(d) draining the first interim dielectric fluid from said apparatus after attaining the PCB concentration of (c) and replacing said first fluid with a second interim dielectric fluid comprised of tetrachloroethylene;

(e) electrically operating said apparatus filled with said second interim dielectric fluid for at least about four months to attain about an equilibrium PCB concentration in the second fluid;

(f) draining the second interim dielectric fluid from said apparatus after attaining the PCB concentration of (e) and replacing said second fluid with a permanent dielectric fluid comprised of silicone fluid;

(g) electrically operating said apparatus filled with said permanent dielectric fluid; and (h) filtering said permanent dielectric fluid through a carbon filter while electrically operating said apparatus filled with said permanent dielectric fluid so as to attain a PCB concentration in the permanent fluid of less than about 50 ppm.

19. The method of claim 18 wherein the electrical induction apparatus is electrically operated with the first interim dielectric fluid for at least about six months.

20. The method of claim 18 wherein the electrical induction apparatus is electrically operated with the first interim dielectric fluid for between about four and 12 months.

21. The method of claim 18 wherein the electrical induction apparatus is electrically operated with the second interim dielectric fluid for at least about six months.

22. The method of claim 18 wherein the electrical induction apparatus is electrically operated with the second interim dielectric fluid for between about four and 12 months.

23. The method of claim 18 wherein the electrical induction apparatus is electrically isolated before draining the dielectric fluid.

24. The method of claim 18 wherein the electrical induction apparatus is flushed with tetrachloroethylene after steps (a) and (d) to remove any PCB from internal and bottom surfaces of the electrical induction apparatus.

25. The method of claim 18 wherein the electrical induction apparatus is monitored to ascertain when equilibrium is reached.

26. The method of claim 18 wherein between steps (a) and (b), gaskets on the electrical induction device are replaced with gaskets of a material compatible with tetrachloroethylene and silicone fluid.

* * * * *